US006651286B2

(12) United States Patent
Pierce

(10) Patent No.: US 6,651,286 B2
(45) Date of Patent: Nov. 25, 2003

(54) QUICK DISCONNECT BURNISHER PAD DRIVER

(75) Inventor: Paul M. Pierce, Grand Haven, MI (US)

(73) Assignee: Tennant Company, Minneapolis, MN (US)

( * ) Notice: Subject to any disclaimer, the term of this patent is extended or adjusted under 35 U.S.C. 154(b) by 11 days.

(21) Appl. No.: 10/041,922

(22) Filed: Jan. 7, 2002

(65) Prior Publication Data

US 2003/0126729 A1 Jul. 10, 2003

(51) Int. Cl.[7] ..... B24D 13/14; B24D 13/20
(52) U.S. Cl. ..... 15/98; 15/49.1; 15/230
(58) Field of Search ..... 15/49.1, 98, 180, 15/230, 385, 340.3, 340.4

(56) References Cited

U.S. PATENT DOCUMENTS

| | | | | |
|---|---|---|---|---|
| 3,376,675 A | * | 4/1968 | Hutchins | 451/508 |
| 3,726,109 A | * | 4/1973 | Mortensen | 464/42 |
| 4,866,804 A | | 9/1989 | Masbruch et al. | |
| 5,123,139 A | * | 6/1992 | Leppert et al. | 15/230.17 |
| 5,138,735 A | * | 8/1992 | Kusz et al. | 15/97.1 |
| 5,608,939 A | | 3/1997 | Waldhauser et al. | |
| 5,946,760 A | * | 9/1999 | Eames, Jr. | 15/230 |
| 5,979,000 A | | 11/1999 | Gansow | |
| 6,523,214 B1 | | 2/2003 | Kaiser | |

OTHER PUBLICATIONS

Nobles SpeedGleam®/Plus Operator and Parts Manual, Rev. 01 (12–00), p. 22.

Castex BR–2250/2500 Burnisher Operator and Parts Manual, Rev. 01 (07–99), p. 24.

* cited by examiner

*Primary Examiner*—Robert J. Warden, Sr.
*Assistant Examiner*—S Balsis
(74) *Attorney, Agent, or Firm*—Price, Heneveld, Cooper, DeWitt & Litton

(57) ABSTRACT

A quick disconnect hub which is secured to the motor drive shaft receives a high pitch threaded pad driver disk to which a burnishing pad is mounted. The hub includes a conically tapered surface, as does the driver disk for centering. A spring-loaded locking pin extends between the burnishing motor and selectively locks the drive hub against rotation for removal of the driver disk by rotating approximately one or two times, thus allowing the removal of the pad driver from the motor and allowing the centered mounting of the burnishing pad to the driver remote from the machine. In a preferred embodiment of the invention, an interlock switch is coupled to the spring-loaded locking pin such that, when the hub is locked against rotation for removal of the driver disk, the switch prevents inadvertent activation of the motor when the hub is locked.

15 Claims, 5 Drawing Sheets

QUICK DISCONNECT BURNISHER PAD DRIVER

BACKGROUND OF THE INVENTION

The present invention relates to a burnishing machine and particularly to a mounting system for quickly disconnecting the pad driver from the motor drive to allow replacement of a burnishing pad.

Commercial burnishers operate at a relatively high speed, as, for example, from 2000 to 2500 rpm. At such high speeds as compared to floor scrubbers which may operate at from 200 to 400 rpm, the burnishing pad must be nearly perfectly centered for balancing to prevent unnecessary vibration and shaking during operation, which could cause excessive wear on the machinery itself as well as make it difficult for the operator to properly utilize the machine. Prior art burnishing machines, such as commercially available Model No. BR-2250/2500 available from the Tennant Company or Model No. 608525 also available from the Tennant Company, provide a burnishing driver which is fixedly mounted to the drive shaft of the motor drive with a threaded fastener, such that in order to replace a burnishing pad it is necessary to tilt the machine to raise the burnishing driver away from the floor surface, reach underneath, remove the used pad, and manually center a new pad in position on the pad driver. Frequently, installation of the pad from the bottom of the machine upwardly is difficult inasmuch as the pad driver has hooks which attach to the pad, making it difficult for an operator to reposition the pad if not properly centered on the first attempt. The Velcro-like hooks prevent shifting of the pad once attached to the pad driver.

One solution to this problem has been to provide a pad driver with an outwardly downwardly flared skirt which only allows the pad to be positioned on the driver within the periphery of the skirt. Such as system, however, presents a downwardly projecting circular edge which, if the burnishing machine is tilted during operation, can gouge and mar the floor being polished utilizing the machine. It also adds cost to the machine.

Some attempts have been made to provide a burnishing machine with a motor housing which tilts upwardly and outwardly from the body of the burnishing machine to provide improved access for the removal and replacement of a burnishing pad. Such construction, however, adds greatly to the cost of the machine and its complexity and, therefore, its tendency to fail during its lifetime. This system is also undesirable because it tends to increase the length of the machine since the motor tipping action prevents components from being located above it.

Although quick disconnect systems have been employed for low speed scrubbing machines, such as represented by U.S. Pat. No. 4,866,804 which provides a scrubbing pad holder which is held in place utilizing a snap-on O-ring coupling, such a coupling is inoperable at speeds in excess of about 1500 rpm and particularly in the range of 2000 to 2500 rpm encountered with high speed burnishing machines. Other low speed scrubbing machines have employed twist-on bayonet-type quick disconnects and spring-loaded, snap-on quick disconnects for removing the scrubber driving disk and associated scrubbing pad from the machines. Again, although suitable for low speed scrubbing devices, they are not sufficiently secure to operate at the high speeds encountered in burnishing machines.

Accordingly, there exists a need for an improved system by which burnishing pads can be relatively easily removed and reinstalled in a centered fashion on a burnishing machine utilizing a reliable, relatively low cost coupling system which is capable of withstanding the high speed operation encountered in the burnishing field.

SUMMARY OF THE INVENTION

The system of the present invention solves the existent problem by providing a quick disconnect hub which is fixedly secured to the motor drive shaft and which receives a spin-off high pitch threaded pad driver disk to which a burnishing pad is mounted. A spring-loaded locking pin is provided between the burnishing motor housing and selectively locks the drive hub against rotation when it is desired to remove the driver disk by rotating two or three times, thus allowing the removal of the pad driver from the motor and allowing the centered mounting of a burnishing pad to the driver remote from the machine. In a preferred embodiment of the invention, the hub and disk are threaded in a direction such that rotation of the hub by the drive motor tends to tighten the disk onto the hub during operation of the burnishe. In a preferred embodiment of the invention, an electrical switch is coupled in series with the power supply for the motor and is actuated by the spring-loaded locking pin such that, when the hub is locked against rotation for removal of the driver disk, the interlock switch prevents inadvertent activation of the motor when the hub is locked. In a preferred embodiment of the invention, the quick disconnect hub includes a conical tapered surface, as does the driver disk, to precisely center the driver disk on the hub upon installation. In another embodiment of the invention, in place of a threaded interconnection between the driver disk and the hub, the hub includes an annular groove and the disk includes a spring-loaded plunger which snap-fits the driver disk to the hub.

These and other features, objects and advantages of the present invention will become apparent upon reading the following description thereof together with reference to the accompanying drawings.

DETAILED DESCRIPTION OF THE PREFERRED EMBODIMENT

Figure 1:
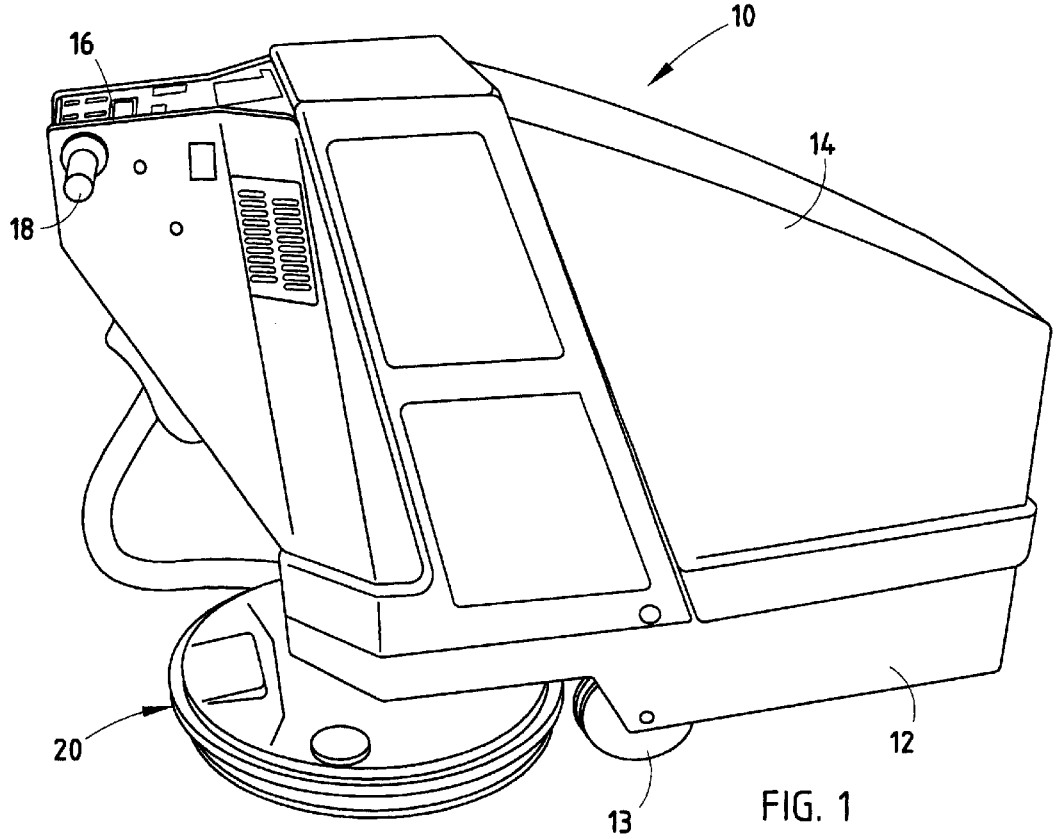
FIG. 1 is perspective view of a burnishing machine embodying the present invention.

Referring initially to FIG. 1, there is shown a burnishing machine 10 of the present invention which includes a conventional framework 12 for supporting the burnishing motor housing, burnishing drive motor and enclosure 14 for, in the embodiment shown, enclosing a battery compartment which supplies operating power to the burnishing motor. A control console 16 with suitable operational controls includes handles 18 for the operation of the machine. The frame 12 supports drive wheels 13 for powering the machine during operation and front castor wheels (not shown) for balancing the machine during operation. A suspension mounted burnishing head 20 is mounted to frame 12 (FIG. 1) and supports and encloses a rotating burnishing pad 30 (FIG. 2) which can be of conventional woven polymeric material which removably engages a floppy disk 32 (FIG. 2) having downwardly projecting Velcro®-type hooks for gripping and mounting the pad to the floppy disk 32. The hooks of the floppy disk 32 are illustrated at 31 in FIG. 3. Housing 20 includes an outer downwardly projecting peripheral skirt 22 made of a flexible polymeric material for preventing debris from escaping the burnishing area during operation of machine 10.

Figure 2:
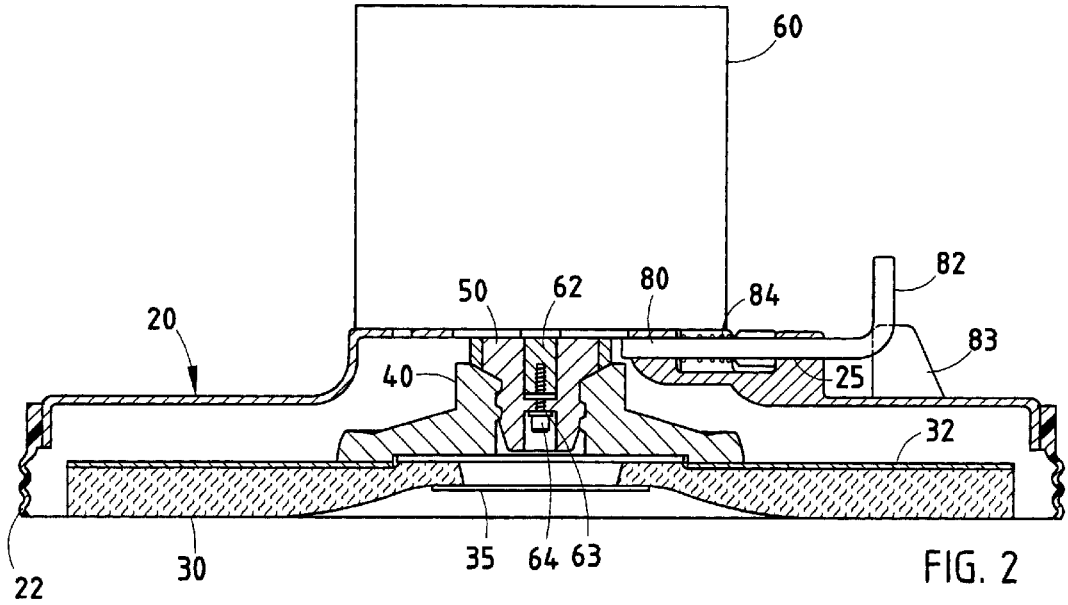
FIG. 2 is a vertical cross-sectional view of the first embodiment of the quick disconnect system of the present invention.
Figure 3:
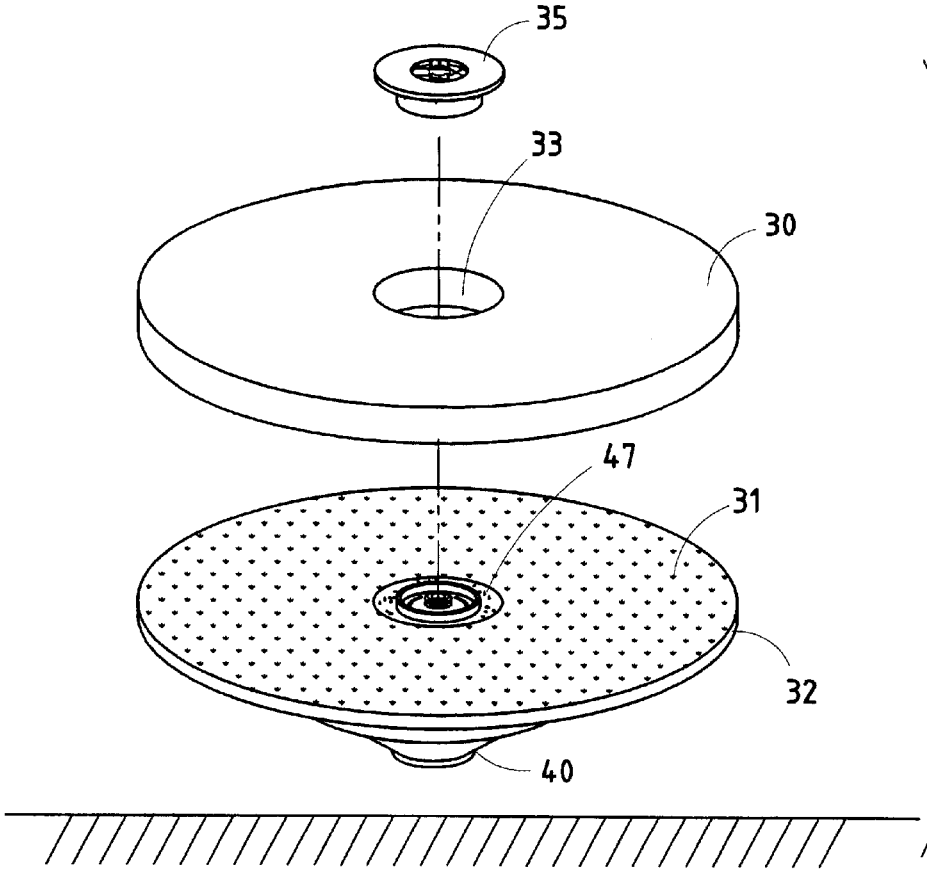
FIG. 3 is an exploded perspective view of the pad driver of the present invention and a replacement pad is shown in a position for replacing the pad.

With the system of the present invention, a pad driver disk 40 can be easily removed from the drive shaft 62 of drive motor 60 by the use of the quick disconnect coupling including the pad driver disk 40 and drive hub 50, which is attached to the drive shaft 62 of the motor, as seen in FIG. 2, utilizing a conventional center threaded bolt 64. The coarsely threaded drive hub 50 and the pad driver disk 40 are shown in detail in FIGS. 4–7 and allow the entire pad head, including the pad 30, floppy disk 32, and driver disk 40, to be easily removed from the burnishing machine 10 and inverted, as illustrated in FIG. 3, such that the operator can place and center the pad visually on the hooks 31 of pad driver floppy disk 32. A conventional, commercially available two-piece spring-loaded center lock assists in holding the pad 30 to the floppy disk 32 in a conventional manner, namely, by the mounting of the collar-like center lock 35 within an aperture 33 of the center of burnishing pad 30 and snap-locking it into the center lock-receiving plate 47 (FIG. 3) screw mounted in the circular recess 47' (FIG. 7) of driver disk 40. Such a center lock does not precisely position the pad with respect to the pad driver assembly but rather assists in holding the pad in position to the floppy disk and driver assembly.

Figure 4:
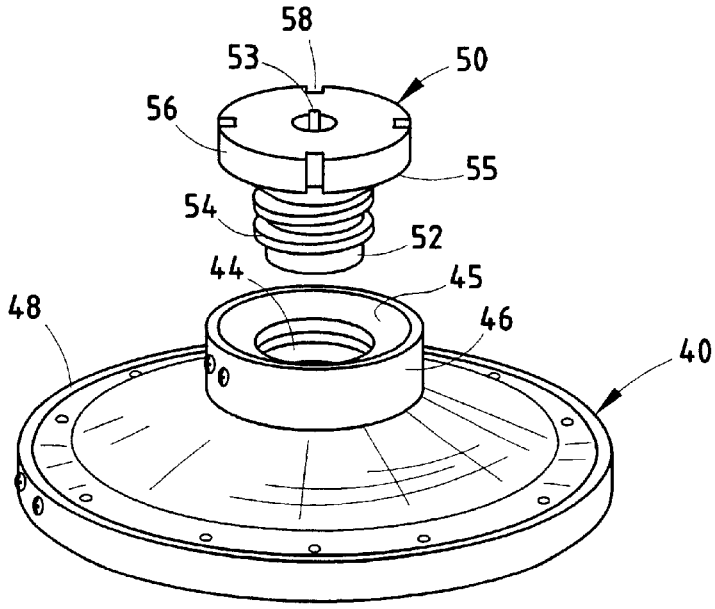
FIG. 4 is an exploded perspective view of the drive hub and driver disk of the present invention.
Figure 5:
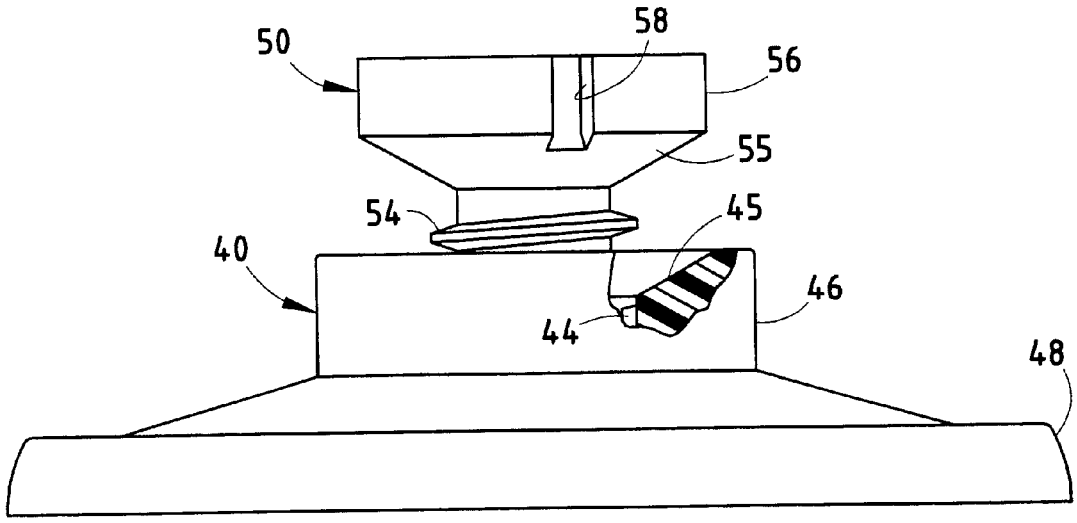
FIG. 5 is an enlarged fragmentary side elevational view, partly broken away, of the drive hub and driver disk, shown partially assembled.
Figure 6:
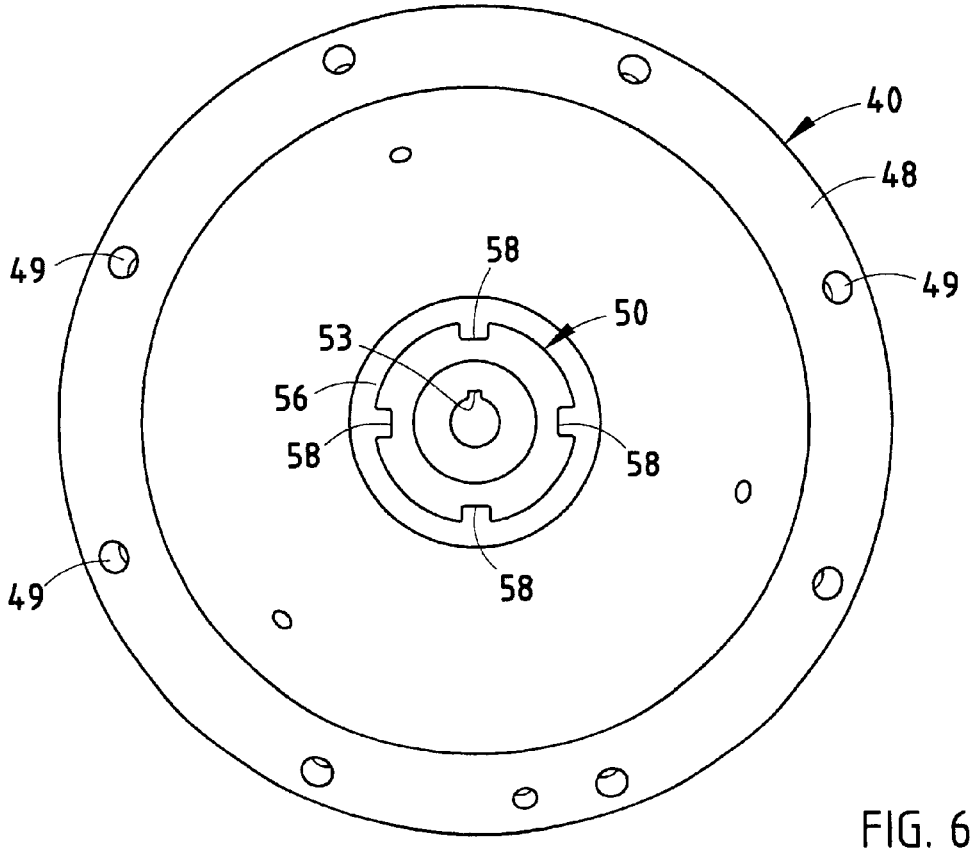
FIG. 6 is a top plan view of the driver hub and driver disk, shown in an assembled position.
Figure 7:
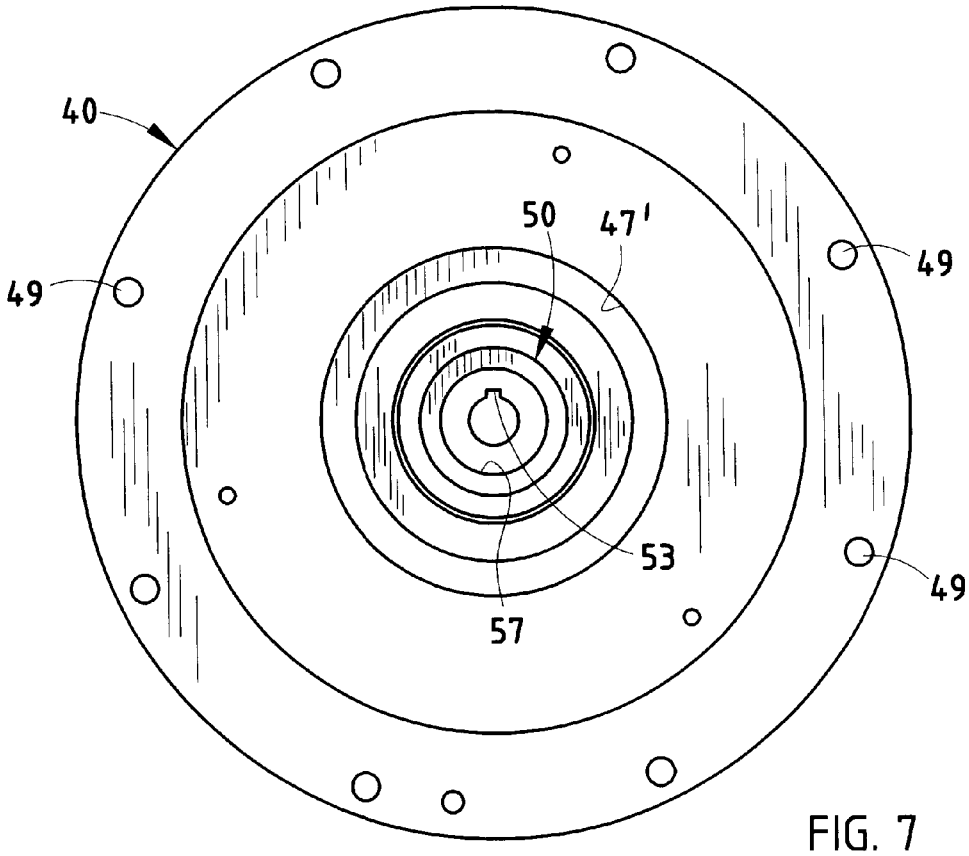
FIG. 7 is a bottom plan view of the driver hub and driver disk, shown in an assembled position.

As best seen in FIGS. 4–6, drive hub 50, which is fixedly attached to the motor drive shaft 62 by bolt 64 (FIG. 2) includes a cylindrical body 52 having high pitched male threads 54 on its outer periphery. The interface between the cylindrical section 52 and the collar section 56 includes a conically tapered wall 55 which mates with the conically tapered wall 45 of driver disk 40 as the driver disk is screwed onto hub 50, as seen in FIG. 5, to align the disk to the hub. Collar 56 includes a plurality of inwardly projecting notches 58 at spaced locations, such as 90° intervals as best seen in FIG. 6, to allow a locking pin 80 (FIGS. 2 and 8) to extend therein and lock the hub against rotation during replacement of the burnishing pad 30 as described in greater detail below. Collar 50 includes a central keyed aperture 53 (FIG. 6) for locking to the keyed drive shaft 62 of the motor and includes a larger mounting aperture 57 (FIG. 7) for receiving the mounting bolt 64 and a face washer 63 for mounting the hub 50 to the motor shaft, as seen in FIG. 2.

The pad mounting driver disk 40 includes a central threaded aperture 44 (FIGS. 2 and 4) which is threaded to matingly receive threads 54 of hub 50 with both threads being machined in either a clockwise or counterclockwise direction to tighten against the rotation of drive shaft 62 of motor 60. Disk 40 includes a central upwardly projecting collar 46 (FIG. 4) having the threaded opening formed therein and an integral outwardly projecting skirt 48 having a plurality of spaced apertures 49 (FIG. 6) formed therein for attachment of the floppy disk 32, which can be of conventional construction. Driver disk 40 is preferably integrally molded of a suitable polymeric material, such as nylon, acetal, or the like, to provide stick-free, easy threading and unthreading of the disk 40 to the metal hub 50, which can be brass, treated steel or other suitable material. The threads 54 and 44 have a relatively high pitch, such that the pad assembly including driver disk 40, floppy disk 32, pad 30 and center lock 35 can be quickly removed by manually spinning the pad assembly from the burnishing machine with approximately one or two 360° rotations. This is accomplished by actuating handle 82 (FIGS. 2 and 8), which is spring-loaded by a spring 84 on housing 20 and which extends within an aperture 25 in housing 20 to project outwardly into one of the apertures 58 in hub 50 locking the driver disk 40 when handle 82 is pushed inward and rotated to allow it to be spring-loaded inwardly for replacement of the pad 30.

Figure 8:
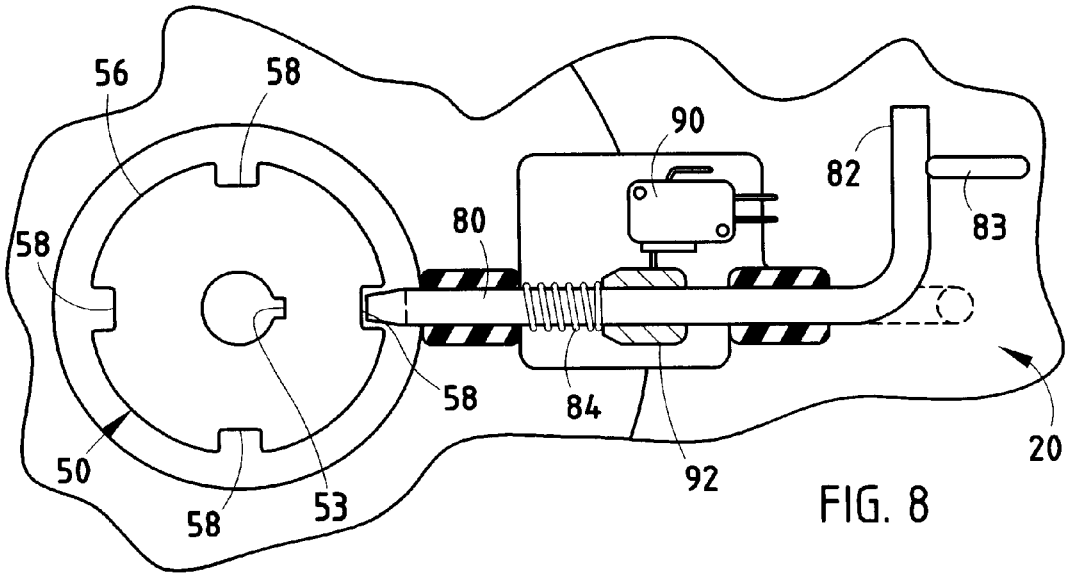
FIG. 8 is a fragmentary top elevational view of the locking pin and safety switch employed in one embodiment of the present invention.

As seen in FIG. 8, a motor shut-off switch 90 is mounted to housing 20 in position to be engaged by a cam 92 on pin 80 such that, when pin 80 projects into one of the notches 58 of hub 50, switch 90 is actuated and interrupts the power supply to the motor. Switch 90 thus prevents inadvertent application of power to motor 60 during replacement of a pad.

In operation, in order to replace a burnishing pad 30, the operator turns off the burnishing machine, pushes inwardly, and rotates handle 82 of locking pin 80 approximately 90° to engage one of the notches 58 in drive hub 50. This also disconnects electrical power from motor 60 through the operation of switch 90. The pad 30, floppy disk 32, and drive hub 40 are then easily removed by rotating the pad assembly typically clockwise two rotations such that the assembly can be removed as seen in FIG. 3. With the assembly removed, the spring-loaded center lock 35 is released, pad 30 pealed away from the hooks 31 on floppy disk 32. A new pad 30 can then be visually centered on the floppy disk 32 with the pad drive assembly removed from the burnishing machine. The new pad and driver disk 40 is then threaded back onto the hub 50 in an opposite direction. The pin and locking handle 82 are released from locking boss 83 (which is part of housing 20) by rotating the handle such that spring 84 pushes pin 80 outwardly and handle 82. This also deactivates switch 90. The driver disk 40 can be hand tightened onto hub 50 and, during operation of the motor, tends to become tighter due to the opposed threading between the hub and disk.

Figure 9:
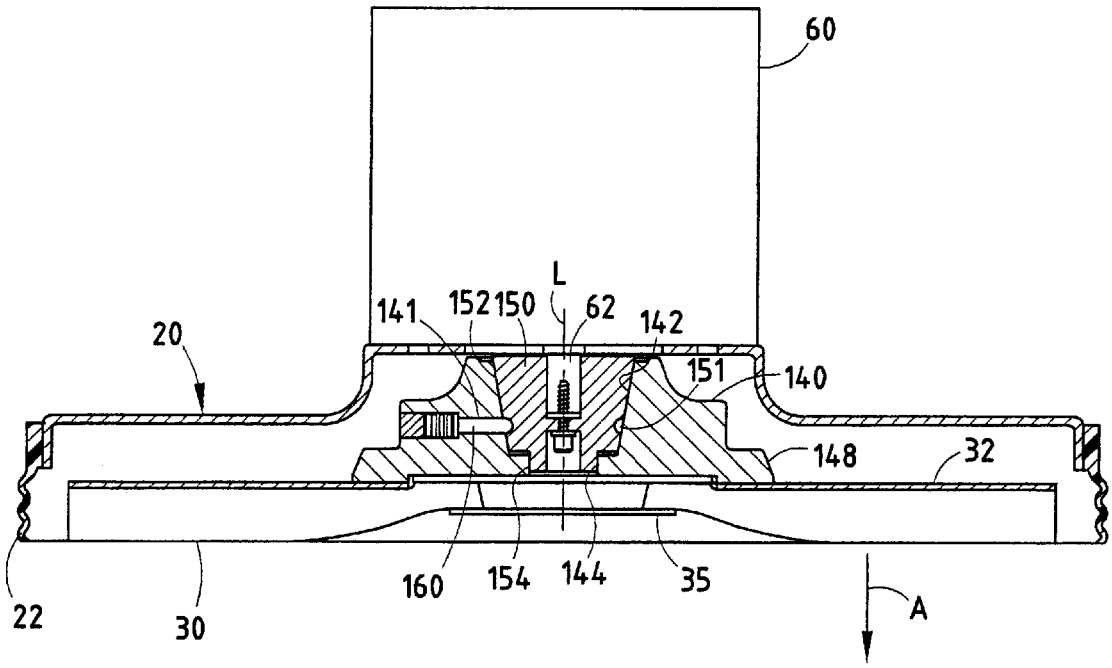
FIG. 9 is a vertical cross-sectional view of an alternative embodiment of the present invention.

In an alternative embodiment of the present invention shown in FIG. 9, a driver disk 140 is provided and snap-fits onto a hub 150, which has a tapered sidewall 152 to matingly receive the tapered recess 142 of driver disk 140. Wall 152 of hub 150 includes an annular detent 151 for receiving a spring-loaded detent locking plunger 160 mounted within an aperture 141 of driver disk 140. In some embodiments, the spring-loaded plunger or pin can be mounted in the hub and the receiving detent formed in the driver disk. Driver disk 140 also includes a peripheral flange 148 as in the first embodiment, with the plurality of apertures for securing the floppy disk 32 thereto. The lower end of hub 150 includes a D-shaped projection 154 and driver disk 140 includes a recess 142 with an inwardly projecting D-shaped opening 144 for receiving projection 154 for connecting driver disk 140 and hub 150 to transmit torque from hub 150 to disk 140 during operation.

In this embodiment, the pad assembly, including driver disk 140, floppy disk 32, and pad 30, is moved in the direction indicated by arrow A directly away from motor 60 to, in effect, unsnap and disconnect the pad assembly from the drive motor. As can be appreciated, driver disk 140 and hub 150 are manufactured such that, during rotation at relatively high speeds, the weight of pin 160 and the recessed aperture 141 for receiving the pin is in balance along the longitudinal axis L of the motor drive shaft 62. In either embodiment, the driver disk and burnishing pad are easily removed from the burnisher 10 for replacement of the pad, allowing its visual centering remote from machine 10, as best seen in FIG. 3.

It will become apparent to those skilled in the art that various modifications to the preferred embodiment of the invention as described herein can be made without departing from the spirit or scope of the invention as defined by the appended claims.

The invention claimed is:

1. A quick disconnect driver allows the easy replacement of a burnishing pad of a burnishing machine which operates at speeds in excess of about 1500 rpm comprising:

a drive hub including an aperture for securing the drive hub to a drive shaft of a burnishing motor, said drive hub having a conically tapered surface for engaging a driver disk for a burnishing pad;

a driver disk for a burnishing pad having a mating conically tapered surface for engaging said tapered surface of said hub; and a quick disconnect structure for releasably coupling said driver disk to said hub, wherein said quick disconnect structure comprises mating threads on said hub and driver disk.

2. The driver as defined in claim 1 wherein said quick disconnect structure includes at least one detent formed in one of said hub and driver disk and a spring-loaded locking pin in the other of said hub and driver disk which engages said detent.

3. A quick disconnect driver allows the easy replacement of a burnishing pad of a burnishing machine which operates at speeds in excess of about 1500 rpm comprising:

a drive hub including an aperture for securing the drive hub to a drive shaft of a burnishing motor, said drive hub having a conically tapered surface for engaging a driver disk for a burnishing pad;

a driver disk for a burnishing pad having a mating conically tapered surface for engaging said tapered surface of said hub; and a quick disconnect structure for releasably coupling said driver disk to said hub, wherein said hub includes at least one locking notch and further including a motor housing and a locking pin extending between said motor housing and said drive hub to engage said notch to selectively lock said hub against rotation to permit said driver disk to be removed for replacing a burnishing pad.

4. The driver as defined in claim 3 and further including an interlock switch mounted to said housing and actuated by said locking pin for preventing actuation of the drive motor when said hub is locked against rotation.

5. A quick disconnect driver assembly for a burnishing machine comprising:

a motor housing;

an electrical motor coupled to said housing and having a drive shaft;

a drive hub including an aperture for securing the drive hub to said drive shaft of said motor;

a driver disk for releasably holding a burnishing pad; and a quick disconnect structure for releasably coupling said driver disk to said hub, wherein said quick disconnect structure comprises mating threads on said hub and driver disk and wherein said drive hub has a conically tapered surface for engaging said driver disk and said driver disk has a mating conically tapered surface for engaging said tapered surface of said hub.

6. The driver assembly as defined in claim 5 wherein said quick disconnect structure includes a detent formed in said hub and a spring-loaded locking pin in said driver disk.

7. The driver assembly as defined in claim 6 wherein said hub and driver disk include engaging surfaces for transmitting torque from said hub to said driver disk.

8. A burnishing machine which operates at speeds above about 1500 rpm having a pad driver for removal from a drive motor to allow the easy replacement of a burnishing pad comprising:

a motor housing;

an electrical motor coupled to said housing and having a drive shaft;

a drive hub including an aperture for securing the drive hub to said drive shaft of said motor, said drive hub having a conically tapered surface for engaging a driver disk for a burnishing pad;

a driver disk for a burnishing pad having a mating conically tapered surface for engaging said tapered surface of said hub; and a quick disconnect structure for releasably coupling said driver disk to said hub, wherein said quick disconnect structure comprises mating threads on said hub and driver disk.

9. The burnishing machine as defined in claim 8 wherein said quick disconnect structure includes at least one detent formed in one of said hub and driver disk and a spring-loaded locking pin in the other of said hub and driver disk which engages said detent.

10. A burnishing machine which operates at speeds above about 1500 rpm having a pad driver for removal from a drive motor to allow the easy replacement of a burnishing pad comprising:

a motor housing;

an electrical motor coupled to said housing and having a drive shaft;

a drive hub including an aperture for securing the drive hub to said drive shaft of said motor, said drive hub having a conically tapered surface for engaging a driver disk for a burnishing pad;

a driver disk for a burnishing pad having a mating conically tapered surface for engaging said tapered surface of said hub; and a quick disconnect structure for releasably coupling said driver disk to said hub, and a locking pin extending between said motor housing and said drive hub to selectively lock said drive hub against rotation to permit said driver disk to be removed for replacing a burnishing pad.

11. The burnishing machine as defined in claim 10 and further including an interlock switch mounted to said housing and actuated by said locking pin for preventing actuation of the drive motor when said drive hub is locked against rotation.

12. A quick disconnect driver assembly for a burnishing machine comprising:

a motor housing;

an electrical motor coupled to said housing and having a drive shaft;

a drive hub including an aperture for securing the drive hub to said drive shaft of said motor; and a driver disk for releasably holding a burnishing pad, wherein said driver disk and said hub include mating threads defining a quick disconnect structure for releasably coupling said driver disk to said hub, wherein said drive hub has a conically tapered surface for engaging said driver disk and said driver disk has a mating conically tapered surface for engaging said tapered surface of said hub.

13. The driver assembly as defined in claim 12 and further including a motor housing and a locking pin extending between said motor housing and said drive hub to selectively lock said hub against rotation to permit said driver disk to be removed for replacing a burnishing pad.

14. The driver assembly as defined in claim 13 and further including an interlock switch mounted to said housing and actuated by said locking pin for preventing actuation of the drive motor when said hub is locked against rotation.

15. The driver assembly as defined in claim 14 wherein said motor rotates said driver disk at a speed of from about 2000 rpm to about 2500 rpm.

* * * * *